United States Patent [19]

McKay et al.

[11] Patent Number: 5,027,095

[45] Date of Patent: Jun. 25, 1991

[54] MOLDED CASE CIRCUIT BREAKER COVER INSERT

[75] Inventors: Geoffrey H. McKay, West Hartford; Harold F. Larkin; Dennis J. Doughty, both of Plainville; Michael C. Guerrette, Plymouth, all of Conn.

[73] Assignee: General Electric Company, New York, N.Y.

[21] Appl. No.: 604,284

[22] Filed: Oct. 29, 1990

[51] Int. Cl.[5] ..... H01H 9/02

[52] U.S. Cl. ..... 335/202; 200/302.3; 200/339

[58] Field of Search ..... 335/46, 193, 202, 201, 335/ 8–10, 90; 200/302.3, 339, 288

[56] References Cited

U.S. PATENT DOCUMENTS

| | | | |
|---|---|---|---|
| 4,169,972 | 10/1979 | Black | 200/339 |
| 4,221,941 | 9/1980 | Genovese | 200/339 |
| 4,626,811 | 12/1986 | McKee et al. | 200/288 |
| 4,861,950 | 8/1989 | Yanai et al. | 200/302.3 |
| 4,884,048 | 11/1989 | Castonguay et al. | 335/202 |
| 4,945,327 | 7/1990 | Doughty et al. | 335/201 |

*Primary Examiner*—Leo P. Picard
*Assistant Examiner*—Lincoln Donovan
*Attorney, Agent, or Firm*—R. A. Menelly; W. C. Bernkopf; F. Jacob

[57] ABSTRACT

A molded case circuit breaker of the type using electrodynamic repulsion to separate the circuit breaker contacts under intense overcurrent conditions also includes an arc chute arrangement for cooling and quenching the arc that occurs during such contact separation. A plastic cover insert added to the interior of the circuit breaker cover multi-functionally retains the arc chute within the circuit breaker case while providing clearance for the circuit breaker operating handle shutter. A resilient pad on the top surface of the cover insert receives the circuit breaker operating handle skirt upon contact separation and dampens the energy imparted to the operating handle and to the circuit breaker cover.

9 Claims, 4 Drawing Sheets

MOLDED CASE CIRCUIT BREAKER COVER INSERT

BACKGROUND OF THE INVENTION

U.S. Pat. No. 4,945,327 entitled "Molded Case Circuit Breaker Variable Arc Exhaust Shield" describes a so-called "current-limiting" circuit breaker wherein the contacts become electrodynamically repulsed upon intense overcurrent conditions to separate the contacts and generate an electric arc independent of the circuit breaker operating mechanism. An arc chute cools and quenches the arc to complete the circuit interruption process. The rapid acceleration provided by the contact arm arrangement allows the circuit to be interrupted in the early stages of the current waveform without requiring a slot motor for added acceleration to the contact arms. The arc chute includes a contact arm damper in the form of a silicone compound arranged at the top of the arc chute intermediate the interior surface of the circuit breaker cover and the topmost arc plate within the arc chute.

U.S. patent application Ser. No. 558,909 filed July 27, 1990 entitled "Molded Case Circuit Interrupter Trip Indicating Handle" includes a slidably mounted handle shutter that cooperates with the operating handle to prevent the arc exhaust gases that occur when the circuit breaker contacts are separated under overcurrent conditions from passing out through the circuit breaker handle access slot. In order for the handle shutter to travel freely within the circuit breaker cover, a part of the interior surface of the circuit breaker cover is removed to provide a shutter clearance shelf. The provision of such a clearance shelf within the interior surface of a molded plastic circuit breaker cover is extremely difficult to form integrally within the interior surface of the circuit breaker cover. U.S. patent application Ser. No. 572,829 filed Aug. 27,1990 entitled "Molded Case Circuit Breaker Cover Insert" describes a separate cover insert that is added to the circuit breaker during the manufacturing process.

It has been determined that the circuit breaker operating handle is rapidly driven first to its 0N position at the edge of the operating handle slot within the circuit breaker cover as the operating mechanism responds to a manual trip operation from the "RESET" position and then rapidly returns to a central TRIPPED position within the slot. To prevent impact damage to the operating handle as well as to the circuit breaker cover, it is expedient to dampen the impact of the operating handle on the circuit breaker cover.

One purpose of the invention accordingly is to provide a cover insert to the interior surface of a molded plastic circuit breaker cover to multifunctionally define a recess for clearance of the circuit breaker operating handle shutter as well as to provide means for dampening the impact between the operating handle and the circuit breaker cover.

SUMMARY OF THE INVENTION

A pair of dove-shaped extensions are provided on the opposing interior surfaces of the center compartment of a multi-pole circuit breaker cover. A shaped plastic cover insert having a dovetail slot on opposing sides cooperates with the dovetail projections to retain the cover insert during the circuit breaker assembly process. A pad of resilient material adhesively-secured to the top surface of the cover insert receives a part of the operating handle skirt during a manual trip operation from the reset position and thereby dampens impact between the operating handle and the edge of the handle slot.

DESCRIPTION OF THE PREFERRED EMBODIMENT

Figure 1:
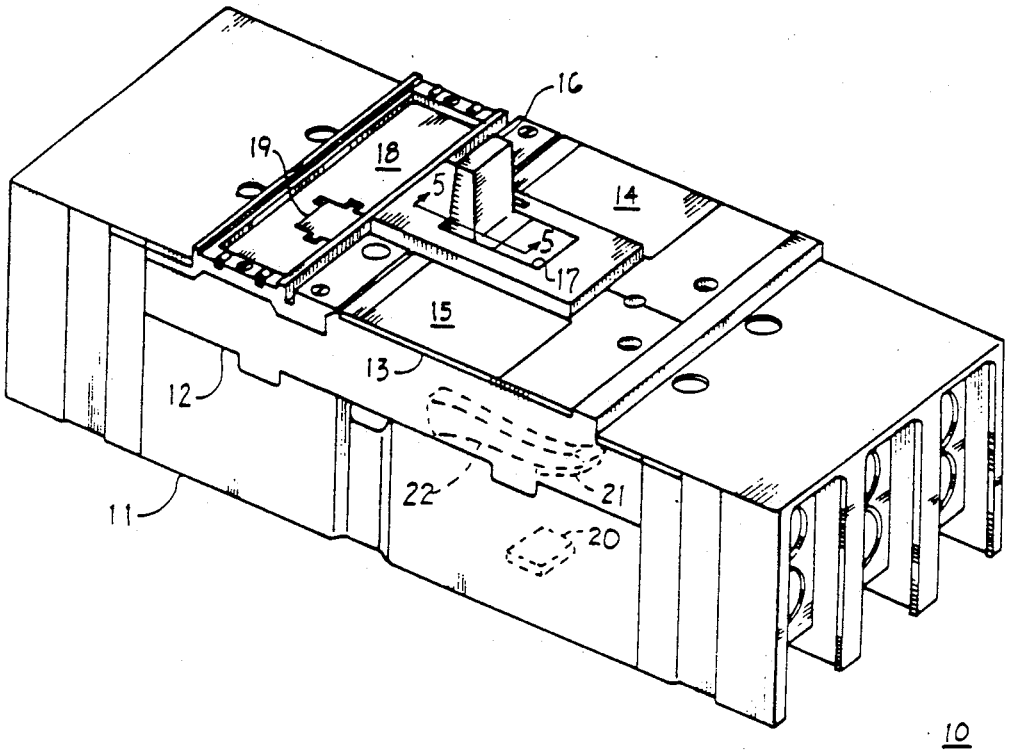
FIG. 1 is a top perspective view of a current limiting circuit breaker containing the impact-dampening pad in accordance with the invention.

A circuit breaker 10 in accordance with the invention is shown in FIG. 1 and includes a molded plastic case 11 to which a molded plastic cover 12 is fixedly secured. An accessory cover 13 is attached to the circuit breaker cover and includes a pair of accessory doors 14, 15 which provide access to an actuator-accessory unit and an optional accessory device such as a shunt trip operator or an auxiliary switch. An operating handle 16 extends through an access slot 17 in the circuit breaker cover for manually turning the circuit breaker contacts 20, 21 between their open and closed conditions. As described earlier, the movable contact arm 22 that supports the movable contact 21 is arranged for electrodynamic repulsion under intense overcurrent conditions whereby the contacts 20, 21 become separated before the circuit breaker operating mechanism has responded. An electronic trip unit 18 is used to determine the occurrence of an overcurrent condition through the contacts and to control the operating mechanism. A rating plug 19 allows a common trip unit to be used over a wide range of circuit breaker ampere ratings.

Figure 2:
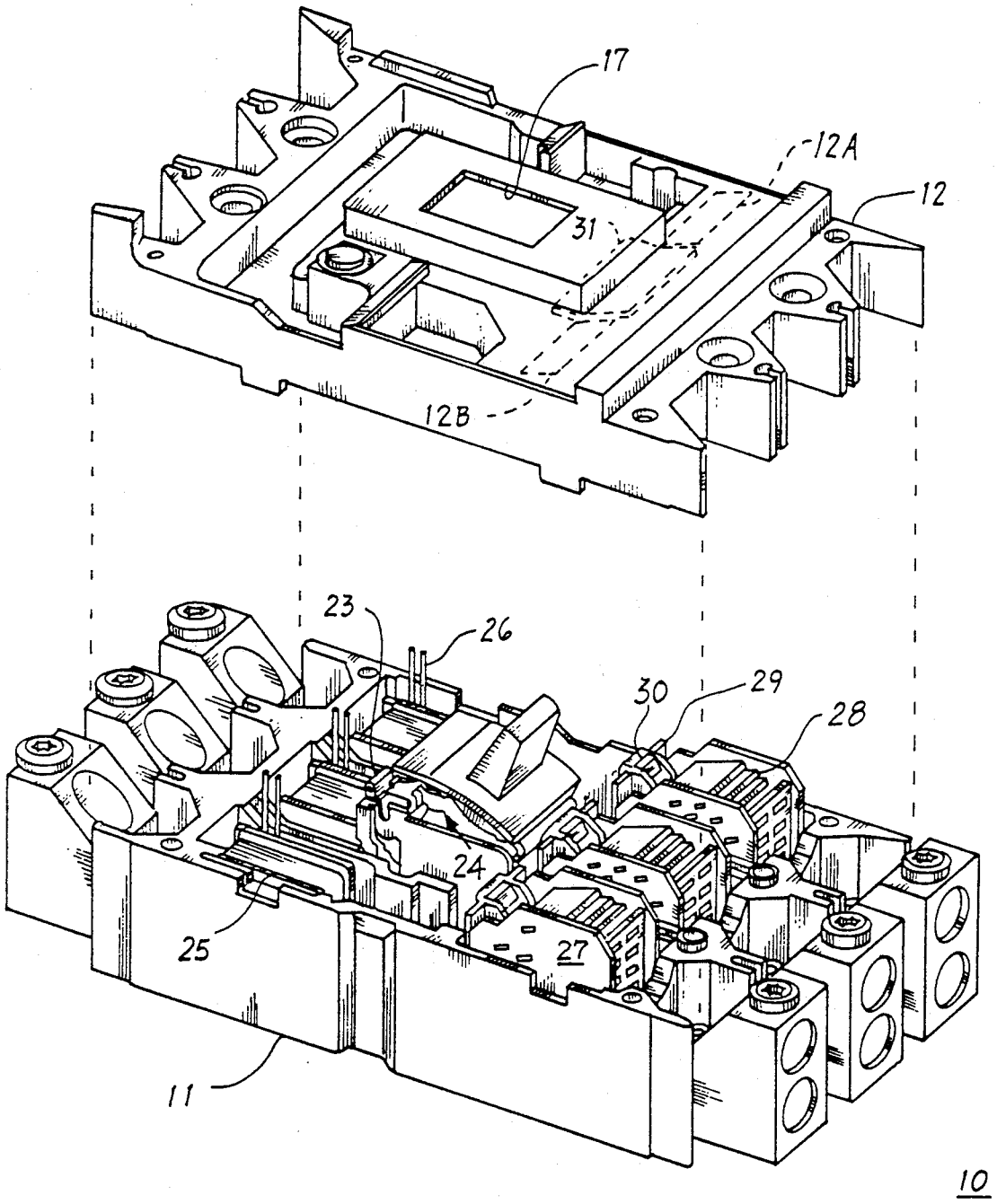
FIG. 2 is a top perspective view of the circuit breaker of FIG. 1 prior to attaching the circuit breaker cover.
Figure 3:
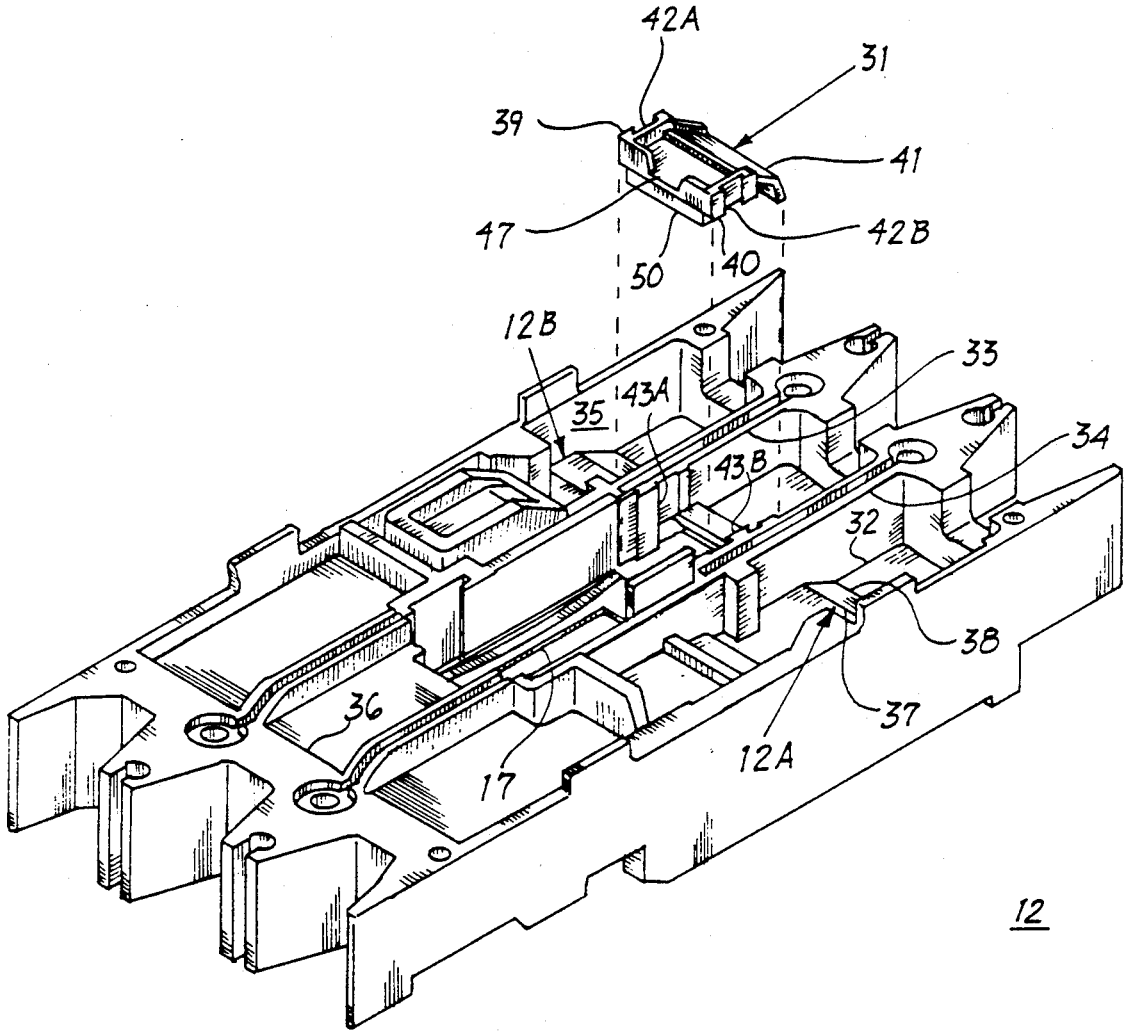
FIG. 3 is a top perspective view of the underside of the cover of FIG. 2 with the cover insert containing the impact-dampening pad in isometric projection.

The circuit breaker 10 is depicted in FIG. 2 prior to attachment between the circuit breaker cover 12 and the circuit breaker case 11. The circuit breaker operating mechanism shown generally at 24 cooperates with the latch assembly 23 to retain the movable contact arms against the urgence of a pair of powerful operating springs (not shown) which are part of the operating mechanism. The circuit current is sensed within current transformers 25, one arranged in each compartment of the three pole circuit breaker depicted in FIG. 2 and electrically connect with the trip unit by means of the upstanding transformer pin connectors 26. As described in aforementioned U.S. Pat. No. 4,945,327, an arc chute assembly 27 including a plurality of arc plates 28 is used to cool and quench the arc that occurs when the contacts within one compartment become separated under intense overcurrent conditions. The arc chutes include a contact arm guide 29 on top of which the silicone bumper 30 is attached. The bumper intercepts the movable contact arm and prevents contact with the interior surface of the circuit breaker case while providing sufficient dampening to the movable contact arm to prevent the contact arm from bouncing back and forcing the movable contact into electric circuit with the fixed contact before the operating mechanism has responded to separate the contacts in the remaining compartments. Platforms 12A, 12B are formed integral with the interior surface of the circuit breaker cover ahead of the circuit breaker operating handle access slot 17 to hold down the arc chutes in the outer compartments when the circuit breaker cover is attached to the circuit breaker case. The platforms contact the associated bumpers and contact arm guides within the outer compartments and thereby trap the arc chutes that are connected with the arm guides between the circuit breaker cover and the circuit breaker case. A cover insert 31 is arranged within the interior of the circuit breaker cover in the manner best seen by referring now to FIG. 3.

The interior surface of the circuit breaker cover 12 is formed by a pair of opposing sidewalls 35 joined by opposing endwalls 36 as indicated. The compartments defining the separate circuit breaker poles are formed by means of partitions 33, 34 extending between the endwalls. The operating handle access slot 17 is formed through the inner surface 32 of the circuit breaker cover and the platforms 12A, 12B are integrally-formed within the outer compartments. Each of the platforms consist of a planar surface 37 joined by a forward extending ramp 38. A clearance shelf 44 is defined under the attached cover insert 31 (FIG. 4) for the complete travel of the shutter in unison with the circuit breaker operating handle. Referring back to FIG. 3, the cover insert 31 is attached to the interior surface of the circuit breaker cover by means of the dovetail projections 43A, 43B formed on the opposing inner surfaces of the barriers 33, 34 and the dovetail slots 42A, 42B formed outboard the opposing sidewalls 39, 40 of the cover insert 31. A planar platform 47 is integrally-formed within the cover insert along with the ramp 41 which extends downwardly from the platform. When the cover insert is positioned within the interior of the circuit breaker cover, with the projections 43A, 43B captured within the corresponding slots 42A, 42B, the cover insert aligns with the platforms 12A, 12B integrally-formed within the cover. In accordance with the invention a thin rectangular impact-dampening pad 50 is adhesively-attached to the bottom surface of the platform 47 as viewed in FIG. 3. The function of the impact-dampening pad 50 will be discussed below in greater detail.

Figure 4:
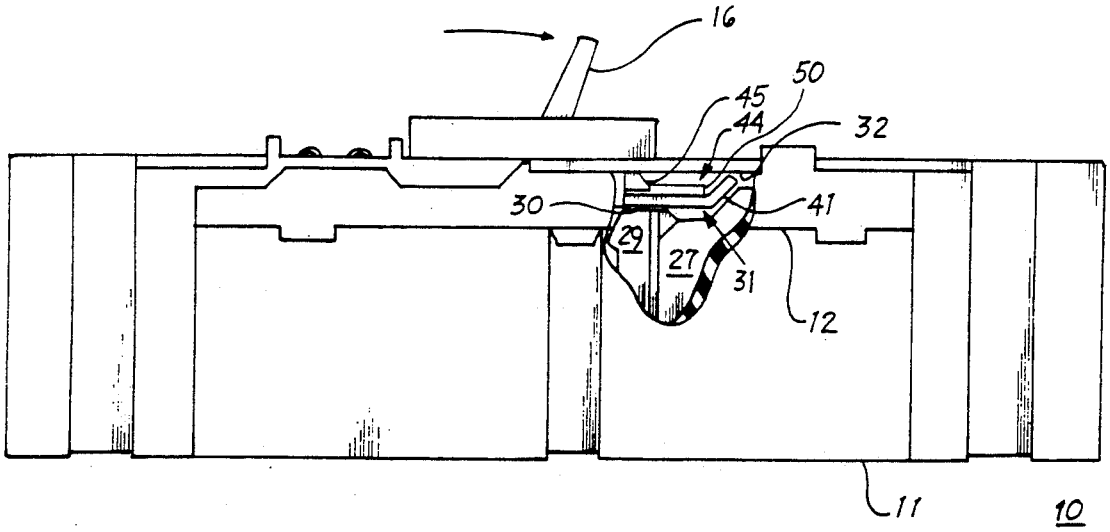
FIG. 4 is an enlarged side view, in partial section, of the circuit breaker of FIG. 1 depicting the impact-dampening pad in accordance with the invention.
Figure 5:
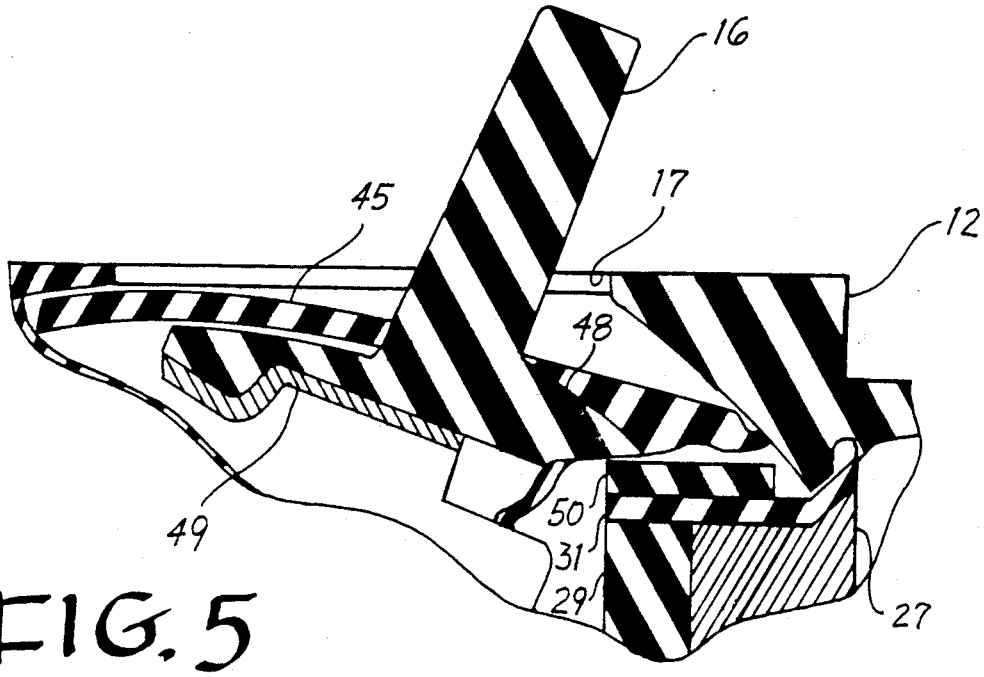
FIG. 5 is an enlarged partial side view of the circuit breaker cover of FIG. 1 depicting the operating handle subsequent to compressing the resilient material.
Figure 6:
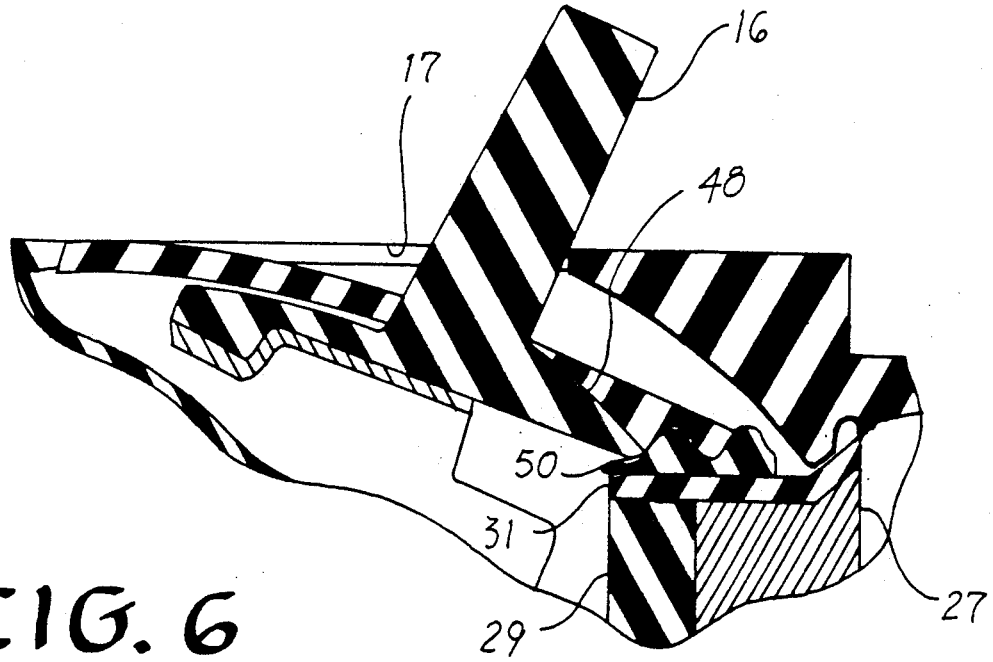
FIG. 6 is an enlarged partial side view of the circuit breaker cover of FIG. 1 depicting the operating handle fully compressing the resilient material.

The cooperation between the cover 12, arc chute 27 and case 11 of the circuit breaker 10 is shown in FIG. 4. With the contact arm guide 29 attached to the arc chute, the top of the arm guide and the bumper 30 contact with and become trapped under the cover insert 31 which is positioned within the inner surface 32 of the cover as described earlier. As described within aforementioned patent application Ser. No. 572,829 the clearance shelf 44 is defined between the inner surface 32 of the cover and the ramp 41 on the cover insert to thereby allow the operating handle shutter 45 to move in unison with the circuit breaker operating handle. The impact-dampening pad 50 is positioned within the space 44 defined over the arc chute 27 and contact arm guide 29 under the operating handle shutter. The operation of the impact-dampening pad 50 is best seen by referring now to FIGS. 5 and 6 which depict the operating handle 16 in the TRIPPED and ON positions respectively. In the TRIPPED position, the operating handle 16 is close to the center of the handle slot 17 in the circuit breaker cover 12 as driven by the operating mechanism to which the operating handle is connected by means of the handle yoke 49. The shutter 45 insures that none of the gases evolved during circuit interruption escape through the handle slot and also electrically isolates the interior of the circuit breaker against casual contact. As described within the aforementioned U.S. patent application Ser. No. 572,829 the cover insert 31 is arranged over the arc chute 27 and contact arm guide 29. The impact-dampening pad 50 fabricated from a silicone composition having excellent resiliency, is adhesively attached to the cover insert and arranged such that the handle skirt 48 contacts the impact-dampening pad before the operating handle 16 contacts the edge of the handle slot 17 should the breaker be manually tripped from the reset position as indicated in FIG. 6 wherein the operating handle momentarily assumes the ON position before returning to the TRIPPED position. The contact between the handle skirt 48 and the impact-dampening pad 50 occurs immediately prior to the contact between the operating handle and the edge of the handle slot and compresses the impact-dampening pad to thereby adsorb the kinetic energy away from the operating handle. The resilient properties of the impact-dampening pad allows the impact-dampening pad to return to its normal position when the operating handle returns to the TRIPPED position.

Having thus described our invention, what we claim as new and desire to secure by Letters Patent is:

1. A circuit breaker comprising:

a molded plastic case and cover;

an operating mechanism within said case;

a pair of separable contacts arranged on corresponding fixed and movable contact arms within said case arranged for becoming separated by operation of said operating mechanism upon occurrence of an overcurrent condition through a protected circuit;

an operating handle within said case and extending through a slot in said cover, said operating handle providing means for manually opening and closing said contacts in the absence of said overcurrent condition;

a handle skirt on a bottom part of said operating handle, said skirt providing connection between said operating handle and said operating mechanism;

an arc chute within said case cooling and quenching an intense arc that occurs upon separation of said contacts, said arc chute extending from a bottom of said case to an interior recess within said cover;

an insert within said interior recess superjacent said arc chute; and an impact-dampening pad on said insert, said impact-dampening pad positioned for receiving a part of said handle skirt upon operation of said operating mechanism to thereby prevent damage to said operating handle and said cover.

2. The circuit breaker of claim 1 including a pair of barriers formed within said recess extending between opposing endwalls on said cover, said barriers including first means attaching said insert to said cover.

3. The circuit breaker of claim 2 including second means formed on said insert cooperating with said first means attaching said insert to said cover.

4. The circuit breaker of claim 3 wherein said insert comprises a plastic piece including a planar part and a ramp part integrally-formed together.

5. The circuit breaker of claim 3 wherein said impact-dampening pad is adhesively-attached to said planar part.

6. The circuit breaker of claim 1 wherein said impact-dampening pad comprises a silicone material.

7. The circuit breaker of claim 1 wherein said impact-dampening pad comprises a rectangular configuration.

8. The circuit breaker of claim 1 including a shutter arranged on said operating handle for preventing egress of arc gases through said slot.

9. The circuit breaker of claim 8 wherein said insert defines a clearance shelf between said arc chute and said cover for passage of said shutter as said operating handle is moved reciprocally within said slot.

* * * * *